US012569021B1

(12) United States Patent
Maresh

(10) Patent No.: US 12,569,021 B1
(45) Date of Patent: Mar. 10, 2026

(54) APPARATUS FOR MINIMIZING THE EFFECTS OF IMPACT FORCES TO THE SKULL

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

(21) Appl. No.: 18/626,321

(22) Filed: Apr. 3, 2024

Related U.S. Application Data

(60) Provisional application No. 63/577,259, filed on Apr. 10, 2023, provisional application No. 63/577,163, filed on Apr. 3, 2023.

(51) Int. Cl.
*A42B 3/04* (2006.01)

(52) U.S. Cl.
CPC ..... *A42B 3/0406* (2013.01)

(58) Field of Classification Search
CPC ..... A42B 3/0406; A42B 3/0473
USPC ..... 2/414
See application file for complete search history.

(56) References Cited

U.S. PATENT DOCUMENTS

| | | | | |
|---|---|---|---|---|
| 3,134,106 | A * | 5/1964 | Shaffer | A63B 71/1291 2/468 |
| 5,517,699 | A * | 5/1996 | Abraham, II | A42B 3/0473 2/205 |
| 6,330,722 | B1 * | 12/2001 | Betts | B64D 25/02 2/416 |
| 10,617,166 | B1 * | 4/2020 | Summerlin | A63B 71/1291 |
| 2009/0064396 | A1 * | 3/2009 | Ghajar | A42B 3/0473 2/411 |

* cited by examiner

*Primary Examiner* — Timothy K Trieu
(74) *Attorney, Agent, or Firm* — Nick A Nichols, Jr.

(57) ABSTRACT

In a method for minimizing the effects of impact forces to the skull, a headgear may be worn to restrict blood flow from one or more of the draining veins in the neck. Pressure applying pad members movably connected to the headgear may be deployed to apply pressure against the veins of the neck.

6 Claims, 11 Drawing Sheets

APPARATUS FOR MINIMIZING THE EFFECTS OF IMPACT FORCES TO THE SKULL

CROSS-REFERENCE TO RELATED APPLICATION

This application claims priority to and the benefit of the filing date of U.S. Provisional Application Ser. No. 63/577,163, filed Apr. 3, 2023, and U.S. Provisional Application Ser. No. 63/577,259, filed Apr. 10, 2023, which applications are herein incorporated by reference in their entirety.

BACKGROUND

The present invention relates generally to devices for minimizing the effects of concussive events that may occur due to high impact forces to the skull.

A concussion may be characterized as a mild traumatic brain injury (mTBI) or a closed brain injury where there is a nonpenetrating injury to the brain with no break in the skull. A concussion may be caused by rapid forward and/or backward movement and shaking of the brain inside the skull that results in bruising and tearing of brain tissue and blood vessels. Concussions are usually caused by impact forces to the skull that may occur in car accidents, falls, sports, explosive blasts, and other high acceleration forces.

Generally, the use of helmets may provide protection to prevent skull and brain injuries when engaged in activities where high acceleration of the skull may occur. Although a helmet may be effective to prevent skull fractures, acceleration of the skull may cause the brain and fluids within the skull to collide with the inside of the skull resulting in bruising and tearing of brain tissue and blood vessels. Increasing the pressure of the fluid contents of the brain may significantly reduce damage to the brain tissue and/or its blood vessels.

By applying light pressure to at least one of the internal jugular veins (IJV) to reduce outflow from the cranial cavity, the intracranial blood volume and pressure may be increased, which reduces the risk of traumatic brain injury and injuries to the spinal column while mitigating what is known in the industry as brain "SLOSH", or the brain's ability to move around in the skull. The blood pressure and blood volume within the cranial cavity may be elevated to effectively, and generally provide a brain cushion inside the skull which reduces acceleration and shock loads that the brain would experience if only a helmet was utilized. Injuries to the inner ear, the internal structure of the eye, and the loss of olfactory functions may also be reduced while increasing volume and pressure of the cochlear fluid, the vitreous humor, and cerebrospinal fluid during high force impacts and/or high accelerations of the head.

SUMMARY

In a method for minimizing the effects of impact forces to the skull, a headgear may be worn to restrict blood flow from one or more of the draining veins in the neck. Pressure applying pad members may be movably connected to the headgear. Pressure pads secured to the pad members may be deployed to apply pressure against the internal jugular veins.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
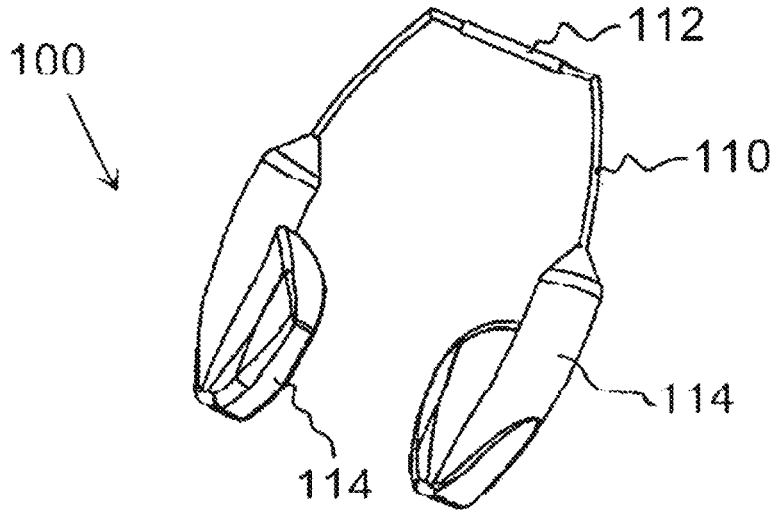
FIG. 1 is a perspective view of a first embodiment of an apparatus for restricting blood flow from the brain through the internal jugular veins.
Figure 2:
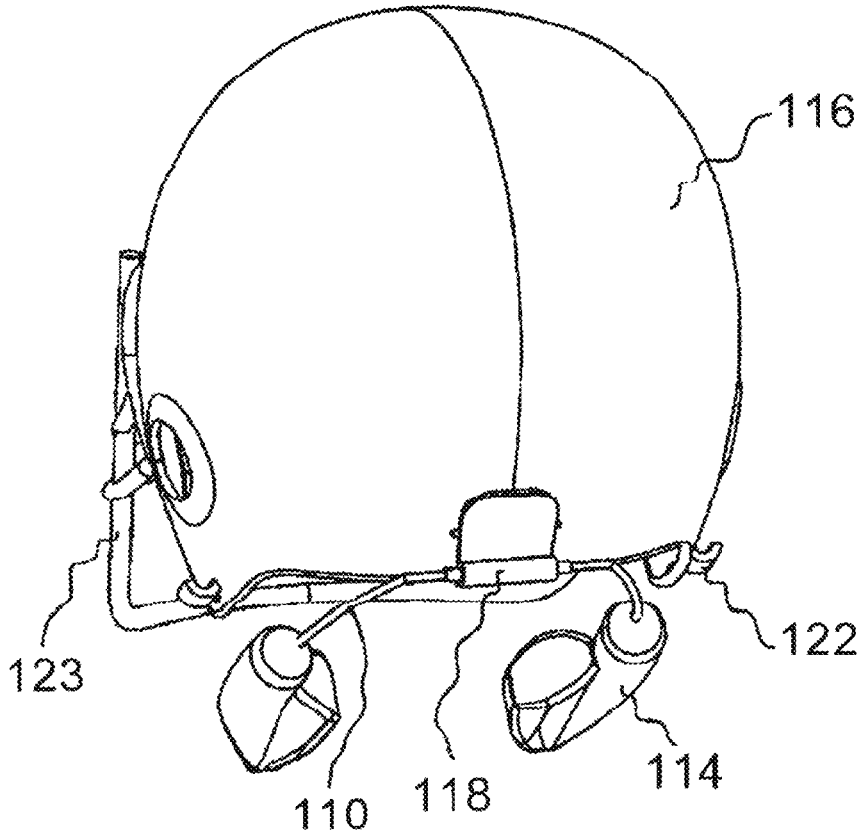
FIG. 2 is a perspective view of the apparatus shown in FIG. 1 secured to a wearer's headgear.

Referring first to FIGS. 1-4, a first embodiment of an apparatus for minimizing the effects of impact forces to the skull is generally identified by the reference numeral 100. The apparatus 100 may include, for example but not limited to, a continuous wire, molded plastic or a combination thereof generally defining a U-shaped body shown in FIG. 1. Longitudinal arms 110 may extend from opposite ends of a cross-member portion 112 of the apparatus 100. Pads 114 may be secured to the forward distal ends of the longitudinal arms 110. The concussion reduction apparatus 100 may be movably secured to a back region of a helmet 116, shown in FIG. 2. The cross-member portion 112 may be rotatably secured to a journal 118 fixedly secured to the back of the helmet 116.

Figure 3:
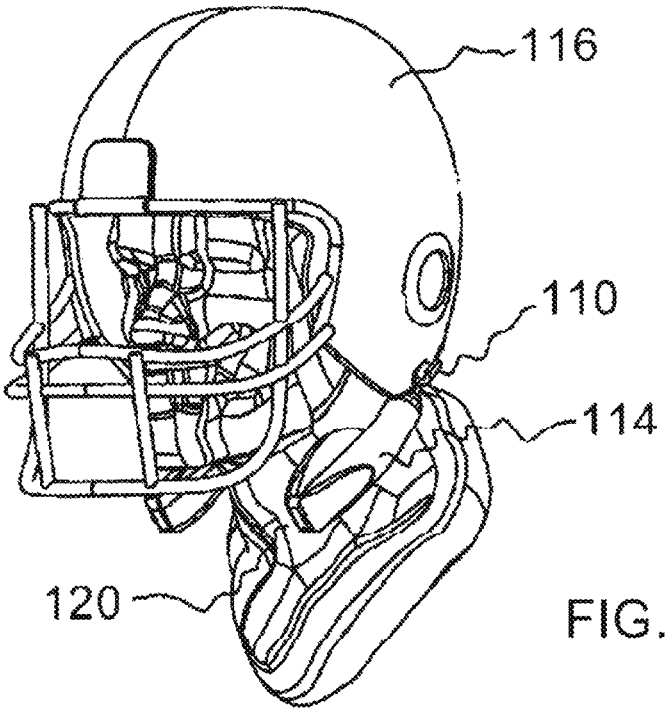
FIG. 3 is a perspective view illustrating the apparatus shown in FIG. 1 in the deployed position.
Figure 4:
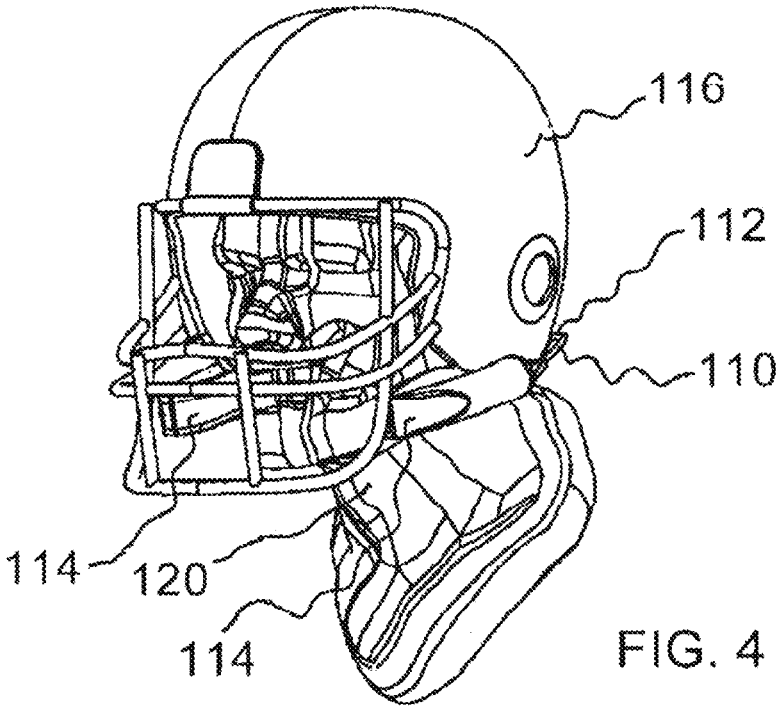
FIG. 4 is a perspective view illustrating the apparatus shown in FIG. 1 in the stowed position.

Referring now to FIG. 3, the longitudinal arms 110 of the apparatus 100 may be deployed to position the pads 114 against opposite sides the user's neck 120. Blood flowing out of a user's cranial cavity through one or more of the draining veins in the neck 120, such as an interior or exterior jugular vein, may be mechanically restricted. This may be accomplished by compressing pads 114 lightly against one or more jugular veins with relatively low pressure, such as but not limited to, 20 mmHg or approximately 0.40 psi (about the same pressure that may be applied by a necktie). Pads 114 may be, for example but not limited to, constructed of foam material, semi-rigid material, and may be inflatable with gas or liquid.

The longitudinal arms 110 are generally flexible so that spring pressure (wire form or leaf spring force) may press the pads 114 against the jugular vein(s) of a user's neck 120. During periods when the risk of concussion is low, the longitudinal arms 110 may be moved to a stowed position, shown in FIG. 4. The longitudinal arms 110 may be flexed laterally outward and swung up to hook them on a hook or hooks 122, or a face guard 123 which are fixedly secured to the helmet 116. Alternatively, a friction connection between the cross member 112 and the journal 118 may maintain the longitudinal arms 110 and pads 114 in the non-deployed "swung up" or stowed orientation without the need for a helmet hook 122.

Figure 5:
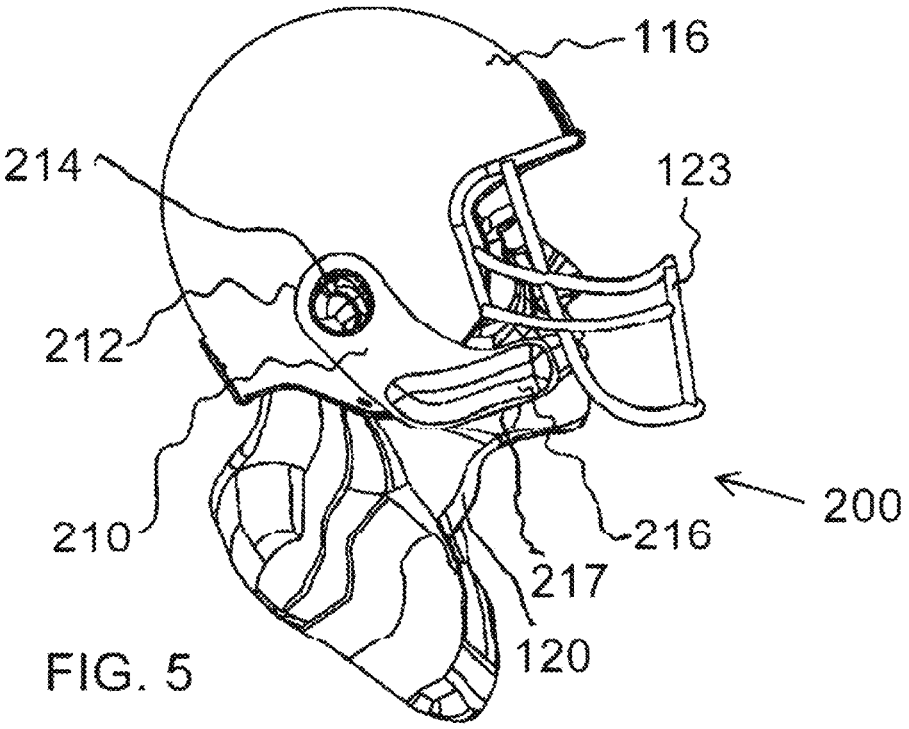
FIG. 5 is a perspective view of second embodiment of an apparatus for restricting blood flow from the brain through the internal jugular veins.
Figure 6:
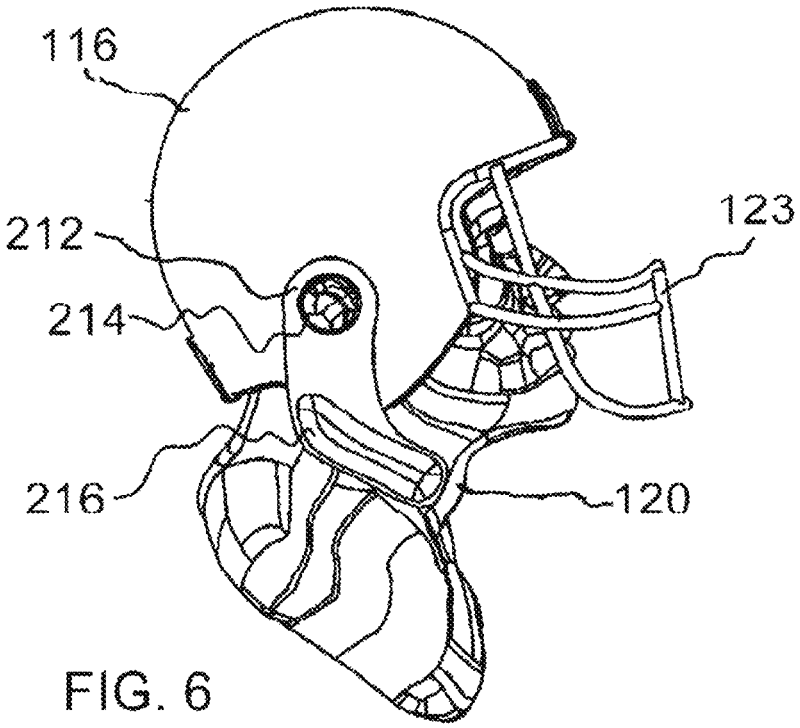
FIG. 6 is a perspective view illustrating the apparatus shown in FIG. 5 in the deployed position.

Referring now to FIGS. 5 and 6, a second embodiment of an apparatus for minimizing the effects of impact forces to the skull is generally identified by the reference numeral 200. As indicated by the use of common reference numerals, the apparatus 200 is similar to the apparatus 100. For purposes of illustration but not by way of limitation, the apparatus 200 may comprise a pair of movable arms 210 mounted on respective sides of the helmet 116. Each of the arms 210 may define a slightly arcuate body. A first end 212 of each of the arms 210 may be rotatably supported at a joint 214 on the helmet 116. Pads 216 may be secured to a second end 217 of each of the arms 210. One or both arms 210 may be rotated downward to the deployed position so that pressure may be applied to the user's neck 120 to compress one or more of the jugular veins. A friction connection may movably connect the arms 210 to the helmet 116. Other means, for example but not limited to, clips and the like may be employed to rotatably secure the arms 210 to the helmet 116. During sporting events, for example but not limited to, football, soccer and hockey, the arms 210 may be rotated to the stowed position shown in FIG. 5 when the occurrence of a concussion event is low and/or to alleviate any user discomfort.

Figure 7A:
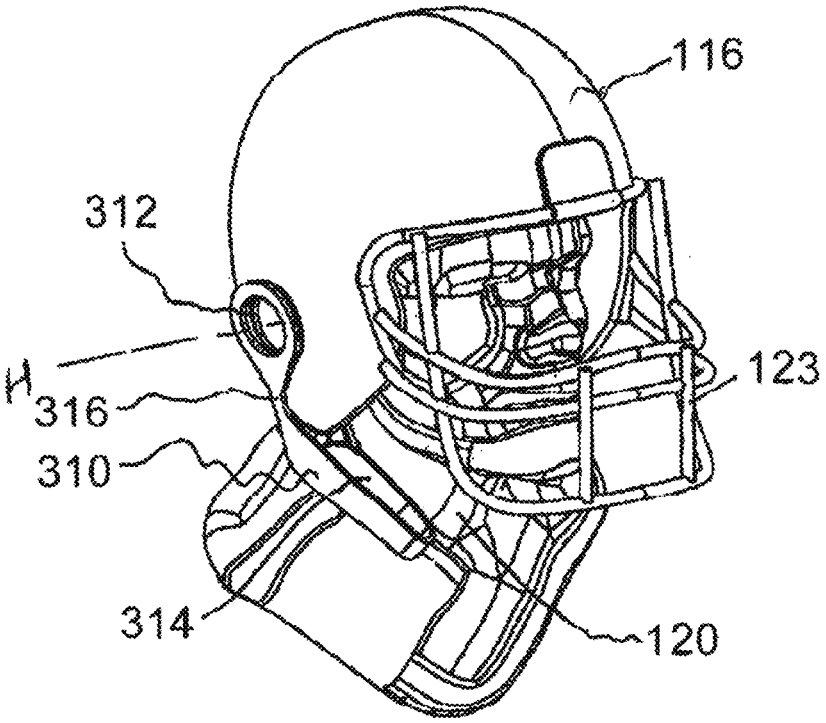
FIG. 7A is a perspective view of a third embodiment of an apparatus for restricting blood flow from the brain through the internal jugular veins in the deployed position.
Figure 7B:
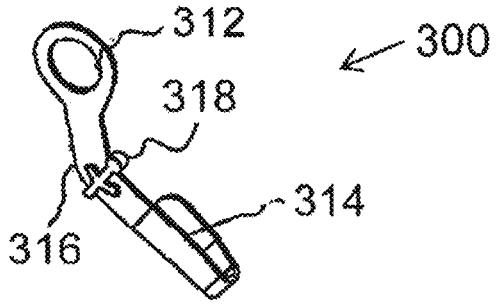
FIG. 7B is a perspective view of the apparatus shown in FIG. 7A illustrating a stiffener adjusting member is a first position.
Figure 7C:
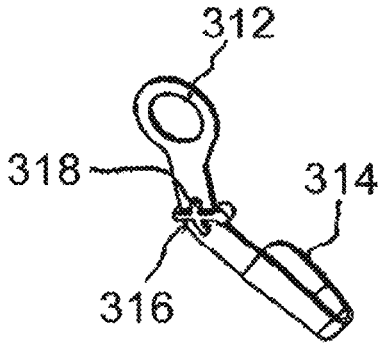
FIG. 7C is a perspective view of the apparatus shown in FIG. 7A illustrating a stiffener adjusting member is a second position.
Figure 8A:
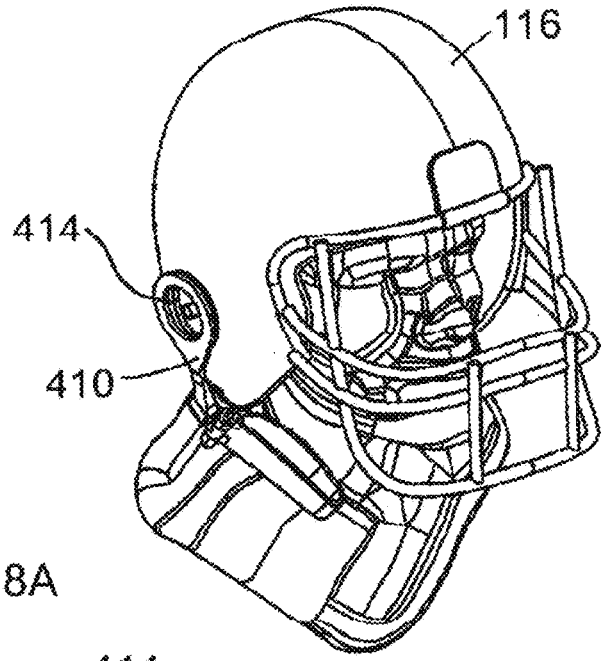
FIG. 8A is a perspective view illustrating a fourth embodiment of an apparatus for restricting blood flow from the brain through the internal jugular veins in the deployed position.
Figure 8C:
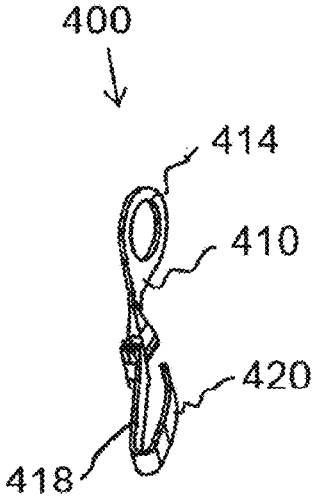
FIG. 8C is a perspective of the assembled apparatus shown in FIG. 8B.
Figure 8B:
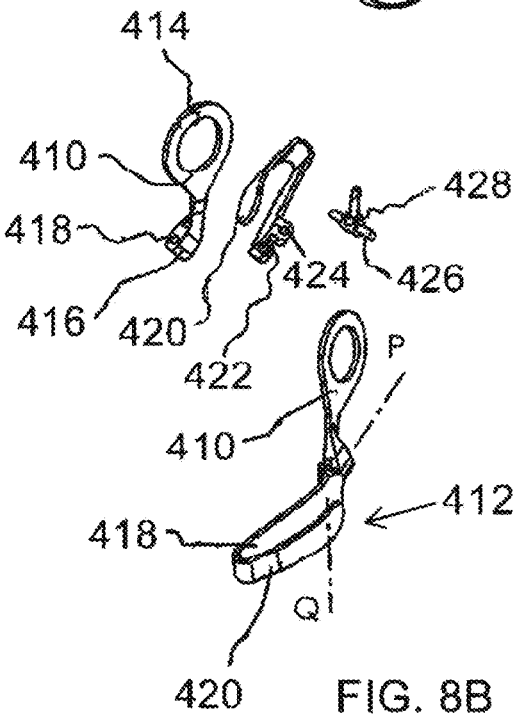
FIG. 8B is an exploded perspective view of the apparatus shown in FIG. 8A.
Figure 8D:
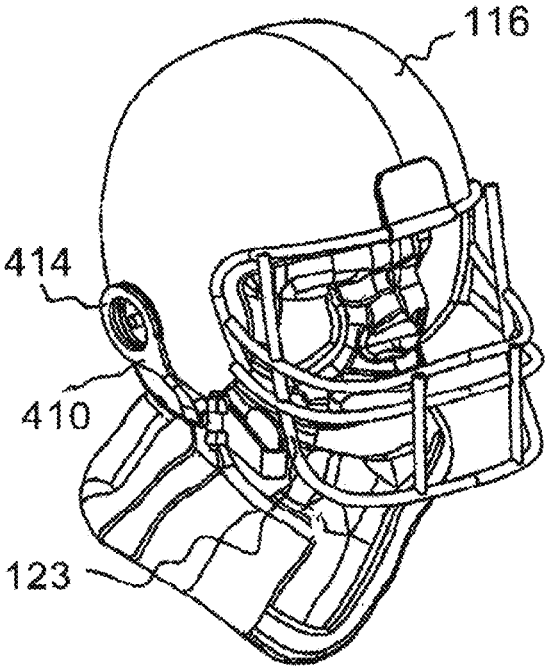
FIG. 8D is a perspective view of the apparatus shown in FIG. 8A in the stowed position.

Referring now to FIGS. 7A-7C, a third embodiment of an apparatus for minimizing the effects of impact forces to the skull is generally identified by the reference numeral 300. As indicated by use of common reference numerals, the apparatus 300 is similar to the apparatus 200. A longitudinal pad member 310 may be rotatably secured to helmet 116 at journal 312 about a generally lateral horizontal axis H. Pad 314 may be secured to longitudinal pad member 310. Longitudinal pad member 310 may include a generally stiff yet flexible region 316 permitting the pad member 310 to be bent and move pad 314 into contact with the user's neck 120. Alternatively, the stiffness of region 316 may be adjusted by providing a slid member 318 which may be frictionally secured to the pad member 310 proximate to the flexible region 316. The stiffness of the pad member 310 may be adjusted by sliding the slide member 318 along the flexible region 316 toward or away from the pivot axis H of the pad member 310, shown in FIGS. 7B and 7C, respectively, to press the pads 314 against the user's jugular vein(s) to provide the pressure recommended for the user, typically, about 20 mmHg.

Referring now to FIGS. 8A-8D, a fourth embodiment of an apparatus for minimizing the effects of impact forces to the skull is generally identified by the reference numeral 400. As indicated by use of common reference numerals, the apparatus 400 is similar to the apparatus 300. The apparatus 400 may include a base member 410 and a pad member 412. The base member 410 may be rotatably secured to helmet 116 at journal 414. The opposite end of the base member 410 may define a lobe 416 having a borehole 418 defining an axis P, shown in FIG. 8D.

The pad member 412 may define a generally U-shaped body having a first leg 418 and a second leg 420. The first and second legs 418, 420 may be spaced apart and oriented substantially parallel to one another. The first leg 418 may include a pair of upstanding tabs 422 proximate to a distal end thereof. The tabs 422 may each include a through hole 424. The through holes 424 may be axially aligned. A shaft 426 of a T-joint 428 may be rotatably secured between the tabs 422 defining an axis Q. The shaft 430 of the T-joint 428 may be received in the borehole 424 of the base member 410 and thereby rotatably connecting the pad member 412 to the base member 410. An unillustrated torsion spring at the T-joint connection further biases the pad member 412 against the user's jugular vein. The axes P and Q may be perpendicular to each other.

Figure 9A:
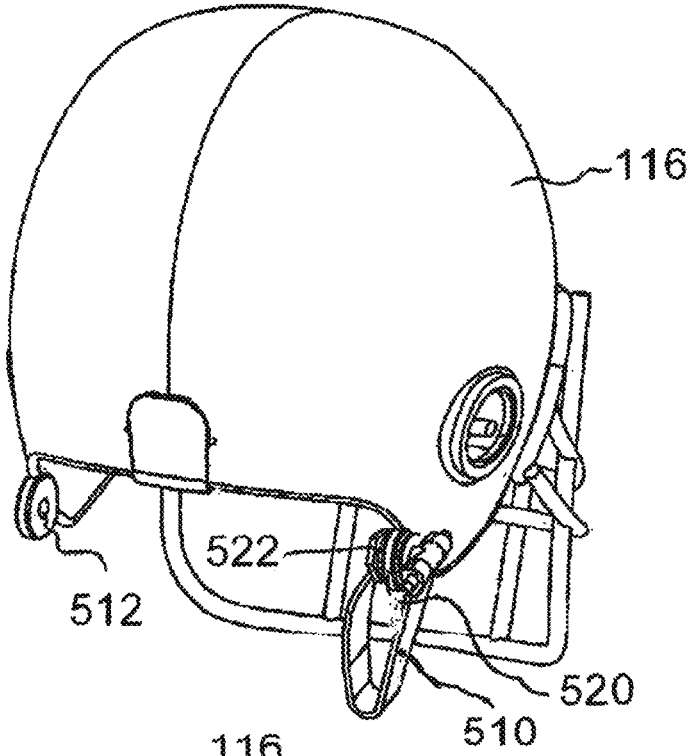
FIG. 9A is a perspective view of a fifth embodiment of an apparatus for restricting blood flow from the brain through the internal jugular veins movably secured to a headgear.
Figure 9B:
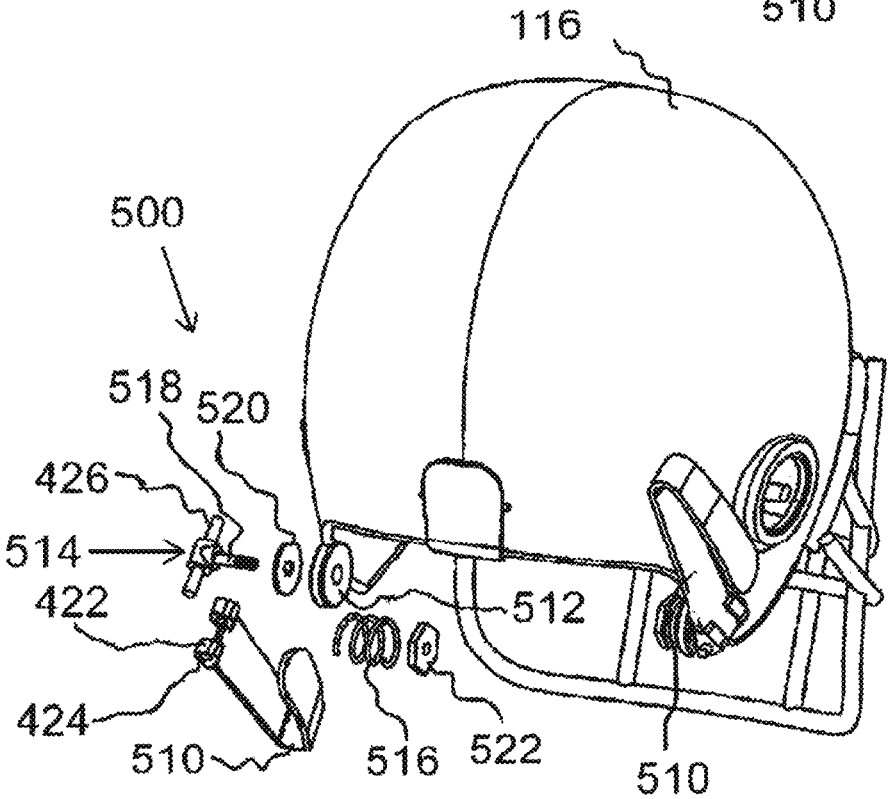
FIG. 9B is an exploded perspective view of the apparatus shown in FIG. 9A.

Referring now to FIGS. 9A and 9B, a fifth embodiment of an apparatus for minimizing the effects of impact forces to the skull is generally identified by the reference numeral 500. As indicated by use of common reference numerals, the apparatus 500 is similar to the apparatus 400. The apparatus 500 may include a pad member 510 rotatably secured to the helmet 116 at a journal 512 which is fixedly secured to the helmet 116. A T-joint 514 may rotatably connect the pad member 510 to the journal 512. The pad member 510 may be spring biased against the user's neck. A spring 516 journaled about a shaft 518 of the T-joint 514 extending through the journal 512 may provide a biasing force to hold the pad member 510 against the user's neck. The spring 516 may be interposed between a thrust washer 520 and an adjusting nut 522 which is threaded to the distal end of the shaft 518. Tightening or loosening the nut 522 adjusts the pressure applied by the pad member 510 to the user's neck.

Figure 10A:
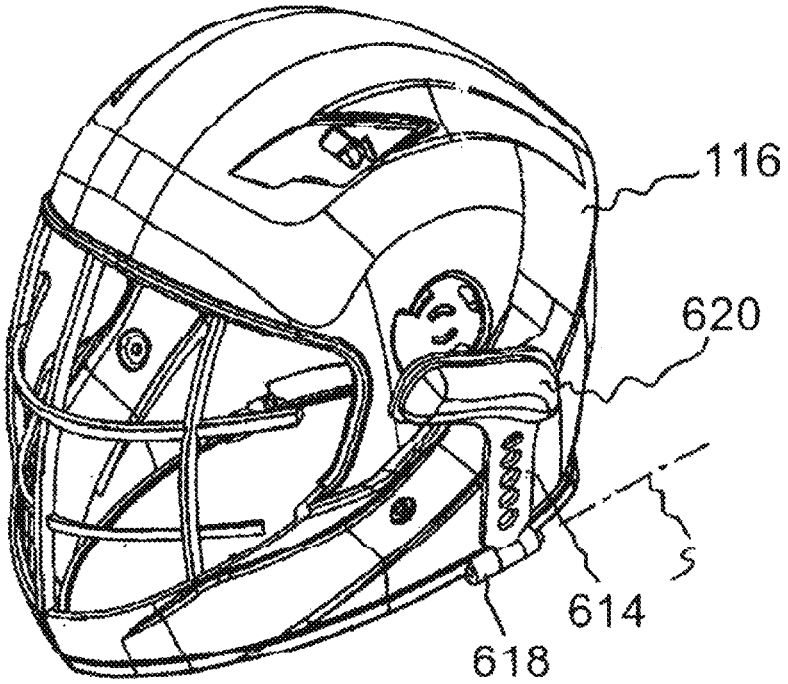
FIG. 10A is a perspective view of a sixth embodiment of an apparatus for restricting blood flow from the brain through the internal jugular veins in the stowed position.
Figure 10B:
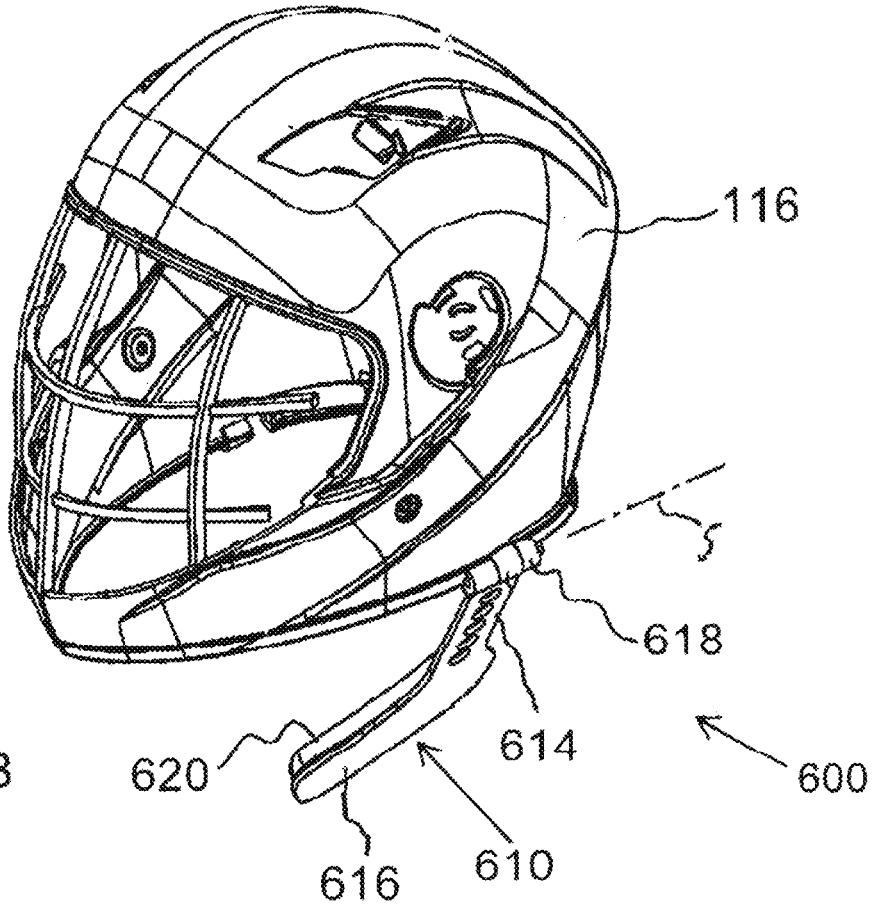
FIG. 10B is a perspective view of the apparatus shown in FIG. 10A in the deployed position.

Referring now to FIGS. 10A and 10B, a sixth embodiment of an apparatus for minimizing the effects of impact forces to the skull is generally identified by the reference numeral 600. For purposes of illustration but not by way of limitation, the apparatus 600 may comprise a pair of arms 610 defining a generally L-shaped body comprising leg members 614 and 616. The leg member 614 may extend generally vertically and may be rotatably secured to the helmet 116 at journal 618. The leg member 616 may project generally horizontally from the lower end of leg member 614 at a slight downward angle. Pads 618 may be secured to leg member 616. One or both arms 610 may be rotated downward to the deployed position shown in FIG. 10B so that pressure may be applied to at least one of the jugular veins in the user's neck 120. A friction connection may movably connect the arms 610 to the helmet 116. Other means, for example but not limited to, clips and the like may be employed to rotatably secure the arms 610 to the helmet 116. While a user is participating in sporting events, for example but not limited to, football, soccer, hockey and other contact sports, the arms 610 may be rotated to the stowed position shown in FIG. 10A when the occurrence of an impact event is low and/or to alleviate any user discomfort.

Figure 11A:
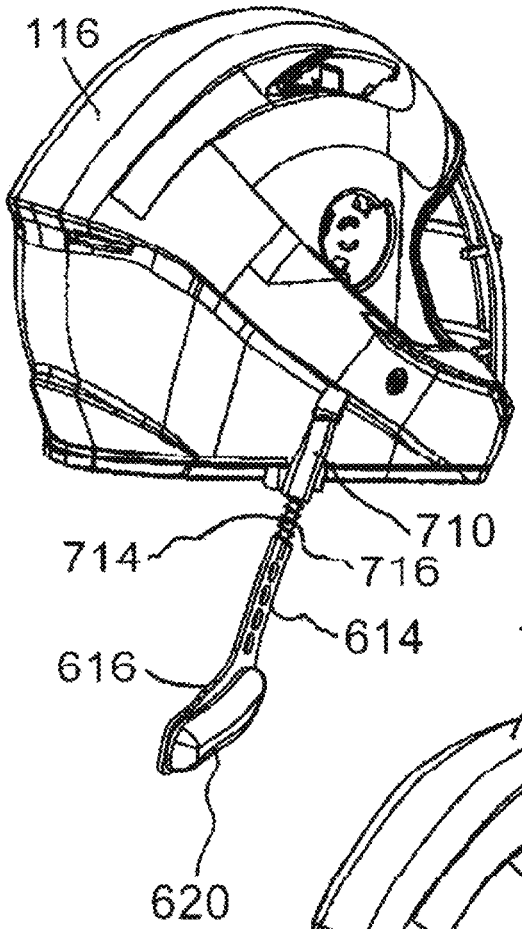
FIG. 11A is a perspective view of a seventh embodiment of an apparatus for restricting blood flow from the brain through the internal jugular veins in the stowed position.
Figure 11B:
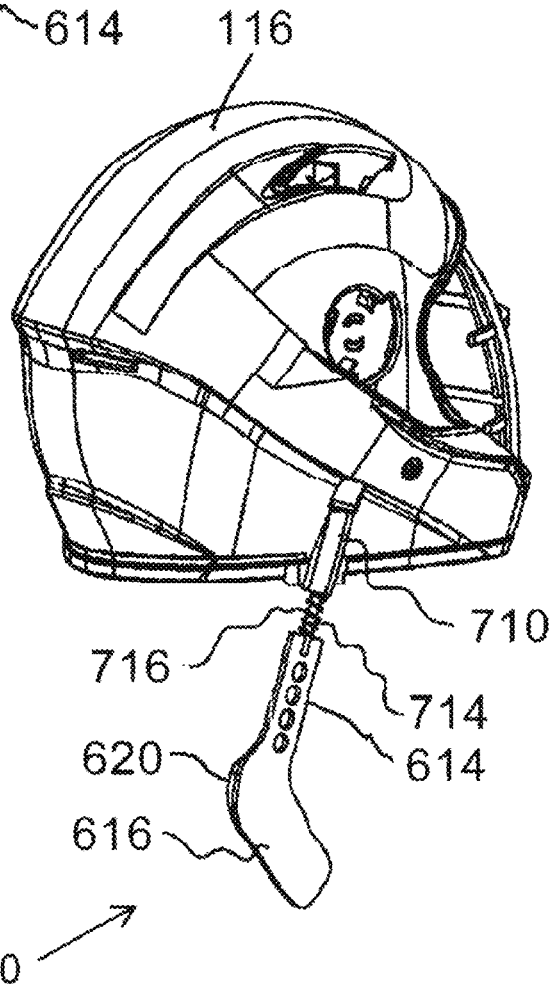
FIG. 11B is a perspective view of the apparatus shown in FIG. 11A in the deployed position.

Referring now to FIGS. 11A and 11B, a seventh embodiment of an apparatus for minimizing the effects of impact forces to the skull is generally identified by the reference numeral 700. As indicated by use of common reference numerals, the apparatus 700 is similar to the apparatus 600 with the exception that the movable arms 610 of the apparatus 700 may be connected at a generally vertically extending journal 710 fixedly secured to the helmet 116. A pin 714 projection from the upper end of leg member 614 may be received in the journal 710. A spring 716 journalled about the pin 714 may apply a downward force to lock the apparatus 700 in a deployed position wherein the pad member 630 may apply pressure to at least one of the jugular veins in the user's neck shown in FIG. 11A. The user may push upward against the force of the spring 716 to disengage the pin 714 and rotate the apparatus 700 to the stowed position away from the user's neck shown in FIG. 11A.

Figure 12A:
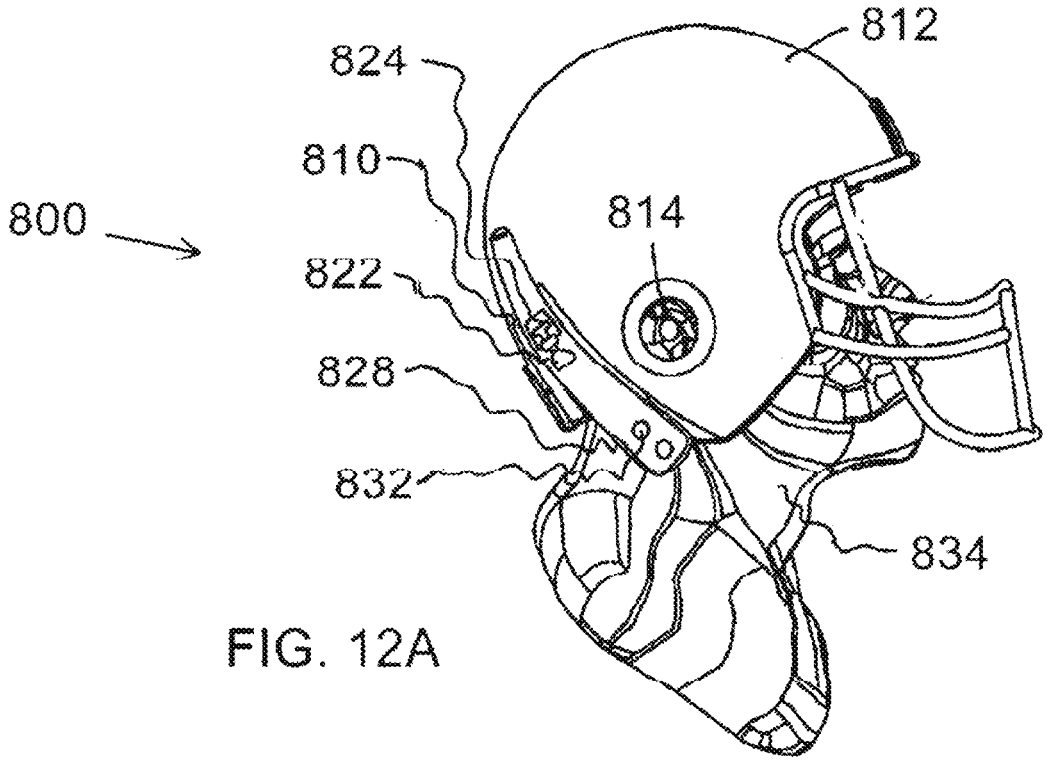
FIG. 12A is a perspective view of an eighth embodiment of an apparatus for restricting blood flow from the brain through the internal jugular veins.
Figure 12B:
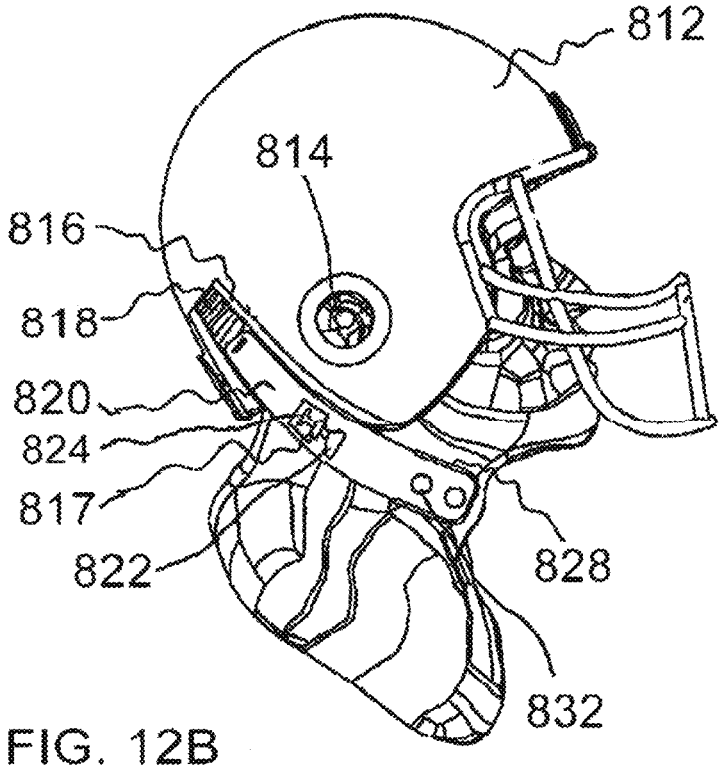
FIG. 12B is a perspective view of the apparatus shown in FIG. 12A in the deployed position.

Referring now to FIGS. 12A and 12B, an eighth embodiment of an apparatus for minimizing the effects of impact forces to the skull is generally identified by the reference numeral 800. The apparatus 800 may include a base 810 fixedly secured to a helmet 812 extending along a edge of the helmet 812 below a helmet opening 814. The base 810 may include upstanding sidewalls 816 along the side edges thereof. Transverse rack teeth 818 may extend between the sidewalls 816 along the length of the base 810. The sidewalls 816 may include longitudinal channels configured to receive side edges of a longitudinal pad member 820. A user may slide the pad member 820 back and forth along the base 810. A thumb tab 822 may be pivotally connected to the top surface of the pad member 820 at a fulcrum 817. The thumb tab 822 may include a pawl 824 proximate to a distal end thereof. The thumb tab 822 may be spring biased forcing the pawl 824 through an opening in the pad member 820 to engage a rack tooth 818 to position the pad member 820 in the deployed position shown in FIG. 12B. Depressing the thumb tab 822 releases the pawl 824 from the rack teeth 818 so that the pad member 820 may be repositioned. The base 810 follows the curvature of the generally spherical helmet 812 so that when the pad member 820 is advanced to the deployed position shown in FIG. 12B, a pad 828 fixedly secured to the inside surface of the pad member 820 by rivets 832 and the like presses against the jugular vein in the user's neck 834.

Figure 13A:
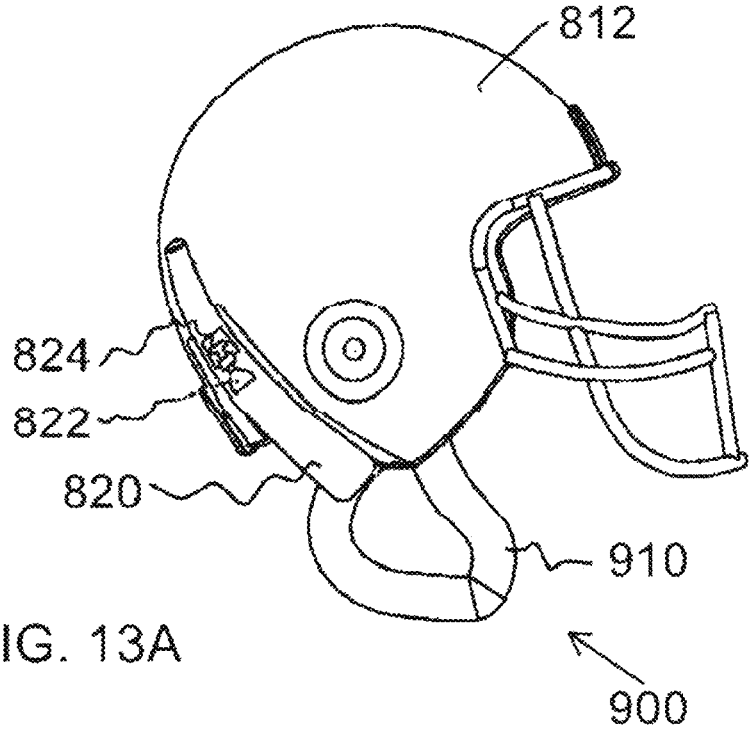
FIG. 13A is a perspective view of a nineth embodiment an apparatus for restricting blood flow from the brain through the internal jugular veins.
Figure 13B:
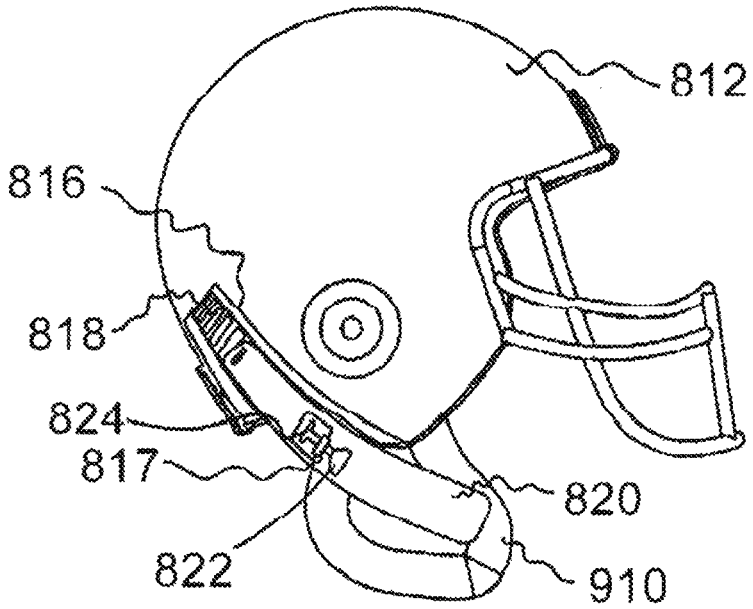
FIG. 13B is a perspective view of the apparatus shown in FIG. 13A in the deployed position.

Referring now to FIGS. 13A and 13B, a ninth embodiment of an apparatus for minimizing the effects of impact forces to the skull is generally identified by the reference numeral 900. As indicated by use of common reference numerals, the apparatus 900 is similar to the apparatus 800 with the exception that an extended jaw pad 910 is fixedly secured the helmet 812. Although the jaw pad 910 and longitudinal pad member 820 may be independently supported on the helmet 812, a compression force may be exerted against the user's jugular vein upon sliding the longitudinal pad member 820 to the deployed position shown in FIG. 12B. Sliding the pad member 820 along the curved path defined by the curvature of the helmet 812 applies pressure to the pad member 820 that is transmitted to the user's neck 834.

A indicated hereinabove, the pads fixed to the pad member may be formed of an elastomer material and/or inflatable with gas or liquid. The user has the option to release the pad(s) from the jugular vein (position two) during periods of low concussion risk thus enabling a comfortable and loose fit of the apparatus when desired. Furthermore, it may be observed that in the ninth embodiment, when the longitudinal pad members 820 are not deployed and jugular vein compression is not occurring, the extended regions of the jaw pads 910 provide side protection of the neck and jaw in a manner that may benefit the user.

Figure 14A:
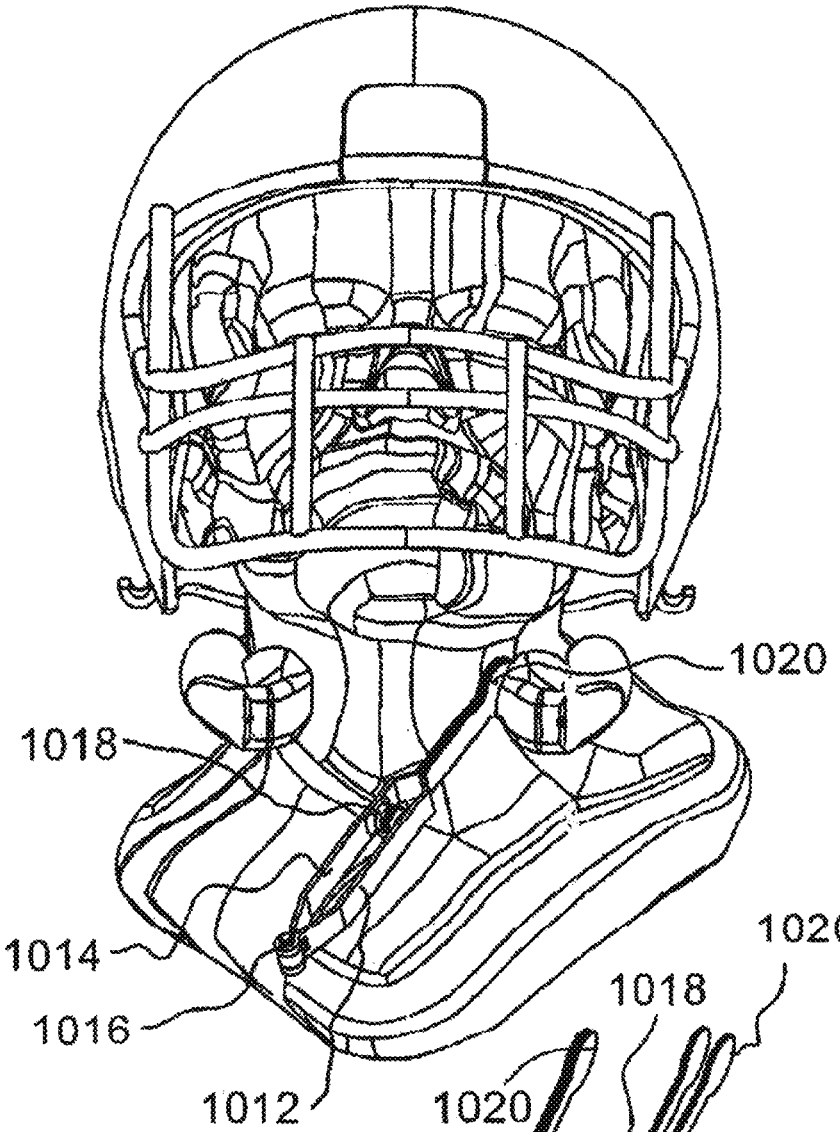
FIG. 14A is a perspective view illustrating a pressure measuring device for verifying the pressure applied by a venous flow restricting apparatus.
Figures 14B, 14C:
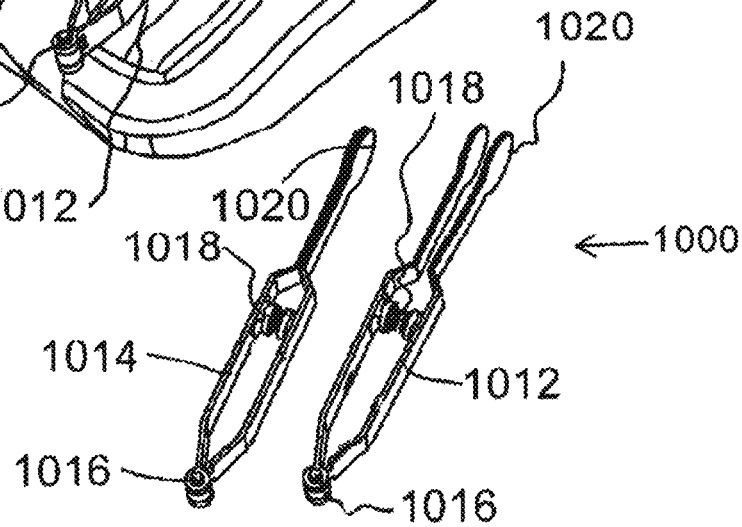
FIG. 14B is a perspective view of the pressure measuring device shown in FIG. 14A.
FIG. 14C is a perspective view of the pressure measuring device shown in FIG. 14B.

Referring now to FIGS. 14A-14C, a pressure measuring tool 1000 may provide a convenient means for verifying the pressure applied to the neck of a user by the apparatus for minimizing the effects of impact forces to the skull described hereinabove. Tool 1010 shown in FIG. 14B is a mechanical pressure measuring tool comprising opposed handles 1012 and 1014 rotatably secured at the distal ends thereof by a pin 1016. A compression spring 1018 may be seated between the handles 1012, 1014. The spring 1018 may be designed to force the paddle ends 1020 of the handles 1012, 1014 apart. Use of the tool 1010 is illustrated in FIG. 10A. The paddle ends 1020 may be slipped between the pressure pad 1024 and the user's neck. If the pressure applied by the pad 1024 is greater than the desired pressure, for example but not limited to, 20 mmHg, the paddle ends 1020 may be forced together, shown in FIG. 14C. If the applied pressure is less than the desired pressure, the paddle ends 1020 separate as shown in FIG. 14C. If the correct pressure is applied by the pad 1024, the separation of the paddle ends 1020 is minimal without the paddle ends 1020 contacting one another. Alternatively, a commercially available electric pressure measuring tool utilizing a thin film pressure sensor may be used to verifying the pressure applied to the user's neck.

While a preferred embodiment of the invention has been shown and described, other and further embodiments of the invention may be devised without departing from the basic scope thereof, and the scope thereof is determined by the claims which follow.

The invention claimed is:

1. An apparatus for minimizing the effects of an impact force to the skull, comprising:

a) first and second pressure applying members movably connected to a headgear;

b) a pressure pad secured to each said first and second pressure applying members;

c) said first and second pressure applying members movable from a stowed position to a deployed position and wherein said first and second pressure applying members comprise longitudinal arms for compressing a respective said pressure pad against opposite sides of a user's neck to restrict blood flow from a user's cranial cavity when the headgear is worn.

2. An apparatus for minimizing the effects of an impact force to the skull, comprising:

a) a substantially U-shaped member defining a continuous flexible body movably secured to a headgear;

b) said flexible body including a cross-member portion and longitudinal arms extending from opposite ends of said cross-member portion said flexible body; and c) a pressure pad secured to a distal end of each said longitudinal arms, said longitudinal arms compressing a respective said pressure pad against opposite sides of a user's neck when the headgear is worn.

3. The apparatus of claim 2 wherein said longitudinal arms are movable from a stowed configuration to a deployed configuration to apply pressure against a user's neck to restrict blood flow from a user's cranial cavity.

4. The apparatus of claim 3 wherein said longitudinal arms apply about 0.40 psi of pressure against the user's neck.

5. The apparatus of claim 2 wherein each said pressure pad comprises foam material or semi-rigid material.

6. The apparatus of claim 2 wherein each said pressure pad is inflatable with gas or liquid.

* * * * *